US006918998B2

(12) United States Patent
Hansen

(10) Patent No.: US 6,918,998 B2
(45) Date of Patent: Jul. 19, 2005

(54) ON-MACHINE-SEAMABLE INDUSTRIAL FABRIC COMPRISED OF INTERCONNECTED RINGS

(75) Inventor: Robert A. Hansen, Stuttgart-Birkach (DE)

(73) Assignee: Albany International Corp., Albany, NY (US)

( * ) Notice: Subject to any disclaimer, the term of this patent is extended or adjusted under 35 U.S.C. 154(b) by 221 days.

(21) Appl. No.: 10/293,818

(22) Filed: Nov. 13, 2002

(65) Prior Publication Data

US 2004/0092182 A1 May 13, 2004

(51) Int. Cl.[7] ..... D21F 7/08; B32B 5/14; D04H 13/00

(52) U.S. Cl. ..... 162/358.2; 162/900; 162/904; 428/105; 428/112; 442/268; 442/362

(58) Field of Search ..... 162/306, 348, 162/358.2, 358.4, 900–904, 116, 117, 361; 28/110, 142; 139/383 A, 383 AA; 428/105, 112, 304.4; 442/59, 60, 334, 352, 327, 268, 381; 198/844.1, 844.2, 845–853

(56) References Cited

U.S. PATENT DOCUMENTS 4,469,221 A * 9/1984 Albert ..... 198/851
4,502,595 A * 3/1985 Wheeldon ..... 198/853
4,564,551 A 1/1986 Best
4,583,302 A 4/1986 Smith
4,799,998 A * 1/1989 Dutt ..... 162/348
4,857,391 A * 8/1989 Westhead ..... 428/222
5,006,399 A 4/1991 Salminen et al.
5,104,724 A 4/1992 Hsu
5,175,037 A * 12/1992 Merckens et al. ..... 428/57
5,178,937 A 1/1993 Janssen et al.
5,364,692 A 11/1994 Bowen, Jr. et al.
5,514,456 A 5/1996 Lefferts
5,534,333 A 7/1996 Keller et al.
5,810,159 A * 9/1998 Dorpmund ..... 198/850
5,946,766 A * 9/1999 Kitamura et al. ..... 15/256.5
6,174,825 B1 * 1/2001 Dutt ..... 442/43
6,402,895 B1 * 6/2002 Best ..... 162/358.2

FOREIGN PATENT DOCUMENTS

EP 0 658 649 A 6/1995
GB 1 598 698 9/1981
WO WO 99/16966 * 4/1999 ..... D21F/1/00

* cited by examiner

*Primary Examiner*—Eric Hug
(74) *Attorney, Agent, or Firm*—Frommer Lawrence & Haug LLP; Ronald R. Santucci

(57) ABSTRACT

An on-machine-seamable industrial fabric comprising rings connected by pintles. In one principal embodiment, the rings are oriented in the machine direction and the pintles extend at an angle, connecting the rings. Such configuration improves the strength of the fabric and provides resistance to needling damage. In another principal embodiment, the rings are oriented in the cross-machine direction and the pintles extend in the machine direction, joining the rings.

24 Claims, 1 Drawing Sheet

ON-MACHINE-SEAMABLE INDUSTRIAL FABRIC COMPRISED OF INTERCONNECTED RINGS

BACKGROUND OF THE INVENTION

1. Field of the Invention

The present invention relates to the papermaking and related arts. More specifically, the present invention is an industrial fabric of the on-machine-seamable variety, such as an on-machine-seamable press fabric for the press section of a paper machine.

2. Description of the Prior Art

During the papermaking process, a cellulosic fibrous web is formed by depositing a fibrous slurry, that is, an aqueous dispersion of cellulose fibers, onto a moving forming fabric in the forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

It should be appreciated that the forming, press and dryer fabrics all take the form of endless loops on the paper machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it exits from the dryer section.

Referring, for the moment, specifically to press fabrics, it should be recalled that, at one time, press fabrics were supplied only in endless form. This is because a newly formed cellulosic fibrous web is extremely susceptible to marking in the press nip by any nonuniformity in the press fabric or fabrics. An endless, seamless fabric, such as one produced by the process known as endless weaving, has a uniform structure in both its longitudinal (machine) and transverse (cross-machine) directions. A seam, such as a seam which may be used to close the press fabric into endless form during installation on a paper machine, represents a discontinuity in the uniform structure of the press fabric. The use of a seam, then, greatly increases the likelihood that the cellulosic fibrous web will be marked in the press nip.

For this reason, the seam region of any workable on-machine-seamable press fabric must behave under load, that is, under compression in the press nip or nips, like the rest of the press fabric, and must have the same permeability to water and to air as the rest of the press fabric, in order to prevent the periodic marking of the paper product being manufactured by the seam region.

Despite the considerable technical obstacles presented by these requirements, it remained highly desirable to develop an on-machine-seamable press fabric because of the comparative ease and safety with which such a fabric could be installed on the press section. Ultimately, these obstacles were overcome with the development of press fabrics having seams formed by providing seaming loops on the crosswise edges of the two ends of the fabric. The seaming loops themselves are formed by the machine-direction (MD) yarns of the fabric. The seam is closed by bringing the two ends of the press fabric together, by interdigitating the seaming loops at the two ends of the fabric, and by directing a so-called pin, or pintle, through the passage defined by the interdigitated seaming loops to lock the two ends of the fabric together. Needless to say, it is much easier and far less time-consuming to install an on-machine-seamable press fabric, than it is to install an endless press fabric, on a paper machine.

One method to produce a press fabric that can be joined on the paper machine with such a seam is to flat-weave the fabric. In this case, the warp yarns are the machine-direction (MD) yarns of the press fabric. To form the seaming loops, the warp yarns at the ends of the fabric are turned back and woven some distance back into the fabric body in a direction parallel to the warp yarns. Another technique, far more preferable, is a modified form of endless weaving, which normally is used to produce an endless loop of fabric. In modified endless weaving, the weft, or filling, yarns are continuously woven back and forth across the loom, in each passage forming a loop on one of the edges of the fabric being woven by passing around a loop-forming pin. As the weft yarn, or filling yarn, which ultimately becomes the MD yarn in the press fabric, is continuous, the seaming loops obtained in this manner are stronger than any that can be produced by weaving the warp ends back into the ends of a flat-woven fabric.

It should be noted that the bending of the yarn back to create the loop, particularly about a small radius, can result in undesired stresses in the yarn portion creating the loop. This results in weakening the yarns at the seam such that they may fail before the yarns in the body, which is undesirable.

In still another technique, an on-machine-seamable multiaxial press fabric for the press section of a paper machine is made from a base fabric layer assembled by spirally winding a fabric strip in a plurality of contiguous turns, each of which abuts against and is attached to those adjacent thereto. The resulting endless base fabric layer is flattened to produce first and second fabric plies joined to one another at folds at their widthwise edges. Crosswise yarns are removed from each turn of the fabric strip at the folds at the widthwise edges to produce seaming loops. The first and second fabric plies are laminated to one another by needling staple fiber batt material therethrough. The press fabric is joined into endless form during installation on a paper machine by directing a pintle through the passage formed by the interdigitation of the seaming loops at the two widthwise edges.

In each case, spiral seaming coils may be attached to the seaming loops at the ends of the fabric by interdigitating the individual turns of a spiral seaming coil with the seaming loops at each end of the fabric and by directing a pintle through the passage formed by the interdigitated yarns and seaming loops to join the spiral seaming coil to the end of the fabric. Then, the fabric may be joined into the form of an endless loop by interdigitating the individual turns of the seaming coils at each end of the fabric with one another, and by directing another pintle through the passage formed by the interdigitated seaming coils to join the two ends of the fabric to one another.

A final step in the manufacture of an on-machine-seamable press fabric is to needle one or more layers of staple fiber material into at least the outer surface thereof. The needling is carried out with the press fabric joined into the form of an endless loop. The seam region of the press fabric is covered by the needling process to ensure that that region has permeability properties as close as possible to those of the rest of the fabric. At the conclusion of the needling process, the pintle which joins the two ends of the fabric to one another is removed and the staple fiber material in the seam region is cut to produce a flap covering that region. The press fabric, now in open-ended form, is then crated and shipped to a paper-manufacturing customer.

In the course of the needling process, the press fabric inevitably suffers some damage. This is because the barbed needles, which drive individual fibers of the staple fiber material into and through the press fabric, also encounter and break or weaken the yarns of the press fabric itself. And, when the seam region of the press fabric is being needled, at least some of the MD yarns which form the seaming loops and, if present, the spiral seaming coils will be somewhat weakened. Damage of this type inevitably weakens the seam as a whole and can lead to seam failure. In this regard, it should be realized that, in the case of a spiral seaming coil, only a small amount of damage could lead to premature seam failure. Because a spiral seaming coil extends transversely across the fabric at the seam region, a break at any point can weaken the seam for a considerable portion of its length, and cause it to unzip or come apart.

In addition to press fabrics, many other varieties of industrial fabric are designed to be closed into endless form during installation on some equipment. For example, papermaker's dryer fabrics may be joined into the form of an endless loop during installation on a dryer section. Dryer fabrics may be so joined with either a pin seam or a spiral seam, seams which are similar to those described above. Other industrial fabrics, such as corrugator belts, pulp-forming fabrics and sludge-dewatering belts, are seamed in similar fashions and are susceptible to seam failure for the same reasons.

Moreover, spiral seaming coils are available in only a limited number of configurations. That is to say, they may only be obtained in a limited number of diameters and pitches (number of turns per unit length). Clearly, an alternative to spiral seaming coils would be greatly appreciated by industrial fabric designers.

A papermaker's "link belt" fabric is disclosed in PCT/US98/05908 and comprises hinge wires extending in the cross-machine direction and a plurality of ring link elements extending in the machine direction. Each ring link element opens in the cross-machine direction and encloses at least two of the hinge wires. The ring link elements may either be solid, or continuous, or split, the latter being used, preferably, to make repairs in a damaged belt. This publication also includes descriptions of two methods for manufacturing the paper machine belts.

U.S. Pat. No. 4,469,221 discloses a papermaker's fabric comprising pintles extending in a cross machine direction and links snapped onto the pintles so that the links extend in a machine direction. Variously shaped link elements are shown. Each link element has holes at its ends for accepting neighboring hinge wires. The holes are not closed completely, but rather are slit to permit them to be expanded and snapped around the hinge wires.

The link belts disclosed in PCT/US98/05908 and U.S. Pat. No. 4,469,221 have the ring link elements only oriented in the machine direction, and not in the cross-machine direction. Further, the hinge wires are only shown to extend in the cross-machine direction, and not in the machine or diagonal directions. With such limited configurations, fabric strength and resistance to needling damage are compromised.

The present invention addresses these shortcomings in the prior art by providing an on-machine-seamable fabric having improved strength and resistance to needling damage.

SUMMARY OF THE INVENTION

Accordingly, the present invention is an industrial fabric manufactured from preformed rings. The rings may be of any shape, including, but not limited to, circular, oval, rectangular, oblique, oblong and tetrahedral, and are connected with machine-direction yarns, pintles or wires to form a flat fabric, whose ends may be joined to one another to form a continuous loop. Alternatively, the rings may be oriented in the cross-machine direction, and connected by yarns oriented in the machine direction. In a further embodiment, the rings, again oriented in the machine direction, are connected by yarns running at an oblique angle, that is, diagonally, relative to the machine direction.

The rings may be manufactured from rigid materials, and may have a solid, homogeneous nature. Alternatively, the rings may be filaments or copolymers, may be of metallic and/or non-metallic materials, and may be either flexible or inflexible. They may be solid, or open at one end and closable by way of a snap. They may also have preformed caps that provide a flatter pressure distribution along their surface. They may further have a hole at each end for the pintles used to connect them to one another. Other materials may be inserted within the rings to reduce the air or liquid permeability, to equalize the differences in permeability between land and open areas, and to help support the rings from deformation within a press.

Several methods of manufacturing the fabric are also described herein.

The present invention eliminates the capital-intensive weaving looms needed for the manufacture of a woven fabric that provides the body of the papermaker's fabric, offers improved strength over spirals used to provide loops that are used in the seaming of the product, provides the ability to create stock that may easily be seamed together to form the finished product, and improves uniformity of the entire structure by eliminating the fundamental difference between the body of the fabric and the seam area.

The present invention will now be described in more complete detail, with reference being made to the figures identified below.

DETAILED DESCRIPTION OF THE PREFERRED EMBODIMENTS

Figure 1:
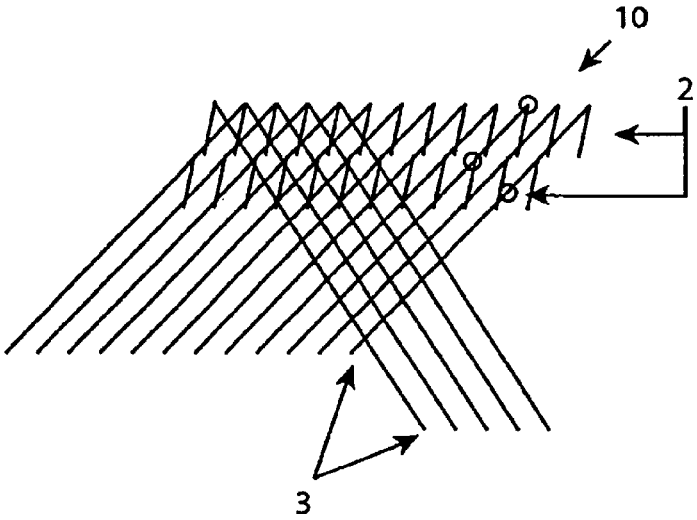
FIG. 1 is a schematic perspective view of a first embodiment of the industrial fabric of the present invention.

Turning now specifically to the figures, which incidentally are not drawn to scale but rather to illustrate the invention and the components thereof, FIG. 1 is a schematic perspective view of a first embodiment of an on-machine-seamable industrial fabric. The fabric 10 takes the form of an endless loop once its two ends have been joined to one another.

In such embodiment, the industrial fabric 10 is comprised of a plurality of preformed rings 2. The rings 2 are oriented in the machine direction and connected by, for example, yarns (or alternatively, pintles or wires) 3, running at oblique angles, that is, diagonally, relative to the machine direction.

Figure 2:
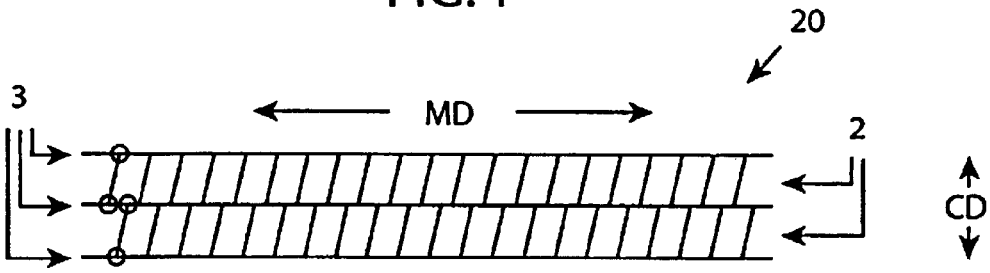
FIG. 2 is a schematic perspective view of a second embodiment of the industrial fabric of the present invention.

FIG. 2 is a schematic perspective view of an alternative embodiment of the industrial fabric 20 of the present invention. In this embodiment, the rings 2 are oriented in the cross machine direction and connected by yarns 3 extending in the machine direction.

Both FIGS. 1 and 2 show the industrial fabric constructed as a single layer of rings. However, such construction is shown as an example only, and the industrial fabric may also have two-, three- or higher number layers of rings, or may be laminated and include several fabric layers. In the latter case, where the fabric is laminated and includes several fabric layers, one or more, including all, of the fabric layers may be on-machine-seamable, and may be made so in accordance with the present invention.

The industrial fabric as described above could be produced without further "treatments." Or, in the case where the industrial fabric is, for example, a press fabric, it may be needled with one or more layers of staple fiber batt material on one or both sides, or may be coated in some manner.

More specifically, staple fiber may be needled into all portions of the industrial fabric in order to mask the body of the fabric, increase stability, and provide a finer surface for improved pressure distribution. The staple fibers may be of any polymeric resin used in the production of paper machine fabrics and other industrial process fabrics, but are preferably of the group including polyamide and polyester resins.

As noted, the industrial fabric may also include coatings on either or both of its two surfaces of polymeric resins, such as polyurethanes or polyamides, applied by methods known in the art, such as full width coating, dip coating and spraying.

Alternatively, the industrial fabric may be used on one of the other sections of a paper machine, that is, on the forming or drying sections, or as a base for a polymeric-resin-coated, paper-industry process belt (PIPB). Moreover, the industrial fabric may be used as a corrugator belt or as a base thereof; as a pulp-forming fabric, such as a double-nip-thickener belt; or as other industrial process belts, such as sludge-dewatering belts.

Where yarns are used to join the rings, they may each be of any of the yarn types used in paper machine fabrics or other industrial process fabrics. That is to say, monofilament yarns, which are monofilament strands used singly, or plied/twisted yarns, in the form of plied monofilament or plied multifilament yarns, may be used as either of these yarns.

Further, the filaments comprising the yarns may be extruded from synthetic polymeric resin materials, such as polyamide and polyester, or are metal wire, and incorporated into yarns according to techniques well-known in the industrial textile fabrics industry and particularly in the paper-making clothing industry.

Where pintles are instead used to join the rings, each pintle may be a single strand of monofilament; multiple strands of monofilament; multiple strands of monofilament untwisted about one another, or plied, twisted, braided or knitted together; or of any of the other pintle types used in paper machine clothing. The pintle may be of metal wire or extruded from synthetic polymeric resin materials.

Figure 3:
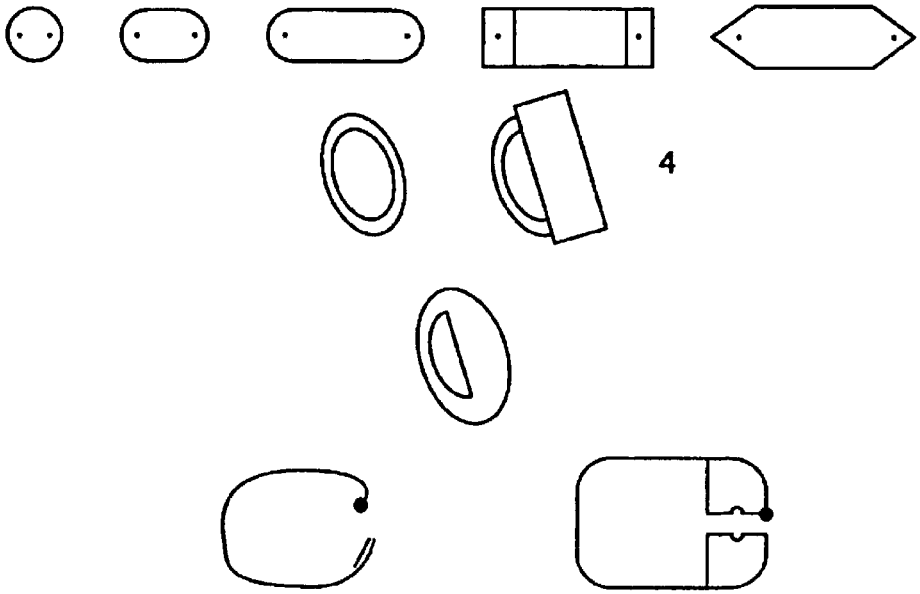
FIG. 3 is a schematic perspective view of rings included in the industrial fabric of the present invention.

As shown in FIG. 3, the rings can have any one of several shapes, such as, for example, circular, oval (elliptical), oblique, oblong, tetrahedral or D-shaped. The material from which the rings are fashioned may be of circular, oval (elliptical), square, rectangular or other cross-sectional shapes, and may have diameters in the range from 0.15 mm to 1.0 mm.

The rings may be manufactured from rigid materials, and may have a solid, homogeneous nature. The rings may be metal or extruded from any of the polymeric resin materials being used for yarns in the industrial textile fabrics industry (e.g., polyamides, polyurethanes, polyketones or polyesters). The rings can be flexible or inflexible. The rings may be solid, or open at one end and mechanically closed at the other by way of, for example, a snap interlock or clamp. The rings may further have a hole at each end to receive, for example, elongated pintles used to connect them to one another. Incidentally, joining the rings in this fashion allows them to pivot on each end, providing the fabric with added flexibility and strength.

The rings could also utilize a preformed cap 4 on one or both sides of the ring that provides a flatter pressure difference across the surface of the ring. The cap 4 could be permeable or impermeable. The rings may be monofilament, plied/twisted filaments or braided filaments. Any of these may be coated with an additional polymeric resin material.

Void volume, if desired, may be provided by the open area included within the fabric structure formed by the rings. Other materials may be inserted in the open areas to reduce the air or liquid permeability, to equalize the differences in permeability between land and open areas, and to help support the rings from deformation within a press. Further, the rings and pintles themselves may be made porous, having, for example, flow-through voids through their solid portions.

Several methods for manufacturing the industrial fabric are suggested. In one method, a woven cloth is used as a "Platform" onto which the rings are snapped or closed about the yarns in one of the two directions of the fabric. More specifically, a flat woven cloth is provided, having a small yarn system in the warp and single monofilament in the weft. This fabric is then placed on an indexing system to allow the rings to be snapped onto the yarns in one of the two directions of the fabric. These steps are repeated until a desired length fabric is produced.

In another method, a length of pintle is inserted onto a frame, rings are snapped about the pintle and indexed forward, and these steps are repeated until a full-length fabric is obtained. This full-length fabric is then joined by bringing the ends together and snapping the rings to a common pintle.

Either of these methods may produce a quantity of "stock" material which could then be sized from a master roll to the desired dimensions. This process may be automated or performed manually.

Modifications to the above would be obvious to those of ordinary skill in the art, but would not bring the invention so modified beyond the scope of the appended claims.

What is claimed is:

1. An on-machine-seamable industrial fabric comprising: a plurality of joining members extending at oblique angles relative to a machine direction; and a plurality of preformed rings oriented in the machine direction, each ring enclosing at least two of the joining members.

2. An on-machine-seamable industrial fabric comprising: a plurality of joining members extending in a machine direction; and a plurality of preformed rings oriented in the cross machine direction, each ring enclosing at least two of the joining members; said rings and said joining members having porosity.

3. An on-machine-seamable industrial fabric comprising: a plurality of joining members extending in a cross machine direction; and a plurality of preformed rings oriented in the machine direction, each ring enclosing at least two of the joining members, said rings and said joining members having porosity.

4. An on-machine-seamable industrial fabric as claimed in claim 1, 2 or 3 wherein the joining members are selected from a group comprising pintles, yarns and wires.

5. An on-machine-seamable industrial fabric as claimed in claim 1, 2 or 3 comprising one or more fabric layers to form a laminate.

6. An on-machine-seamable industrial fabric as claimed in claim 1, 2, or 3 further comprising at least one layer of staple fiber material attached to said fabric.

7. An on-machine-seamable industrial fabric as claimed in claim 1, 2, or 3 wherein said fabric is coated with a polymeric coating.

8. An on-machine-seamable industrial fabric as claimed in claim 7 wherein said coating is selected from a group comprising polyurethanes and polyamides.

9. An on-machine-seamable industrial fabric as claimed in claim 7 wherein said coating is applied using a method selected from a group comprising full width coating, dip coating and spraying.

10. An on-machine-seamable industrial fabric as claimed in claim 1, 2 or 3 wherein said fabric is impregnated with a polymeric resin.

11. An on-machine-seamable industrial fabric as claimed in claim 10 wherein the resin is selected from a group comprising polyurethanes and polyamides.

12. An on-machine-seamable industrial fabric as claimed in claim 1, 2 or 3 wherein a respective ring has a shape selected from a group comprising circular, oval, oblique, oblong, tetrahedral and D-shaped.

13. An on-machine-seamable industrial fabric as claimed in claim 1, 2 or 3 wherein a respective ring is made of metal.

14. An on-machine-seamable industrial fabric as claimed in claim 1, 2 or 3 wherein a respective ring is made of polymeric resin material selected from a group comprising polyamide, polyester, polyurethane, and polyketone resins.

15. An on-machine-seamable industrial fabric as claimed in claim 1, 2 or 3 wherein a respective ring is a type selected from a group comprising monofilament, plied/twisted filaments or braided filaments.

16. An on-machine-seamable industrial fabric as claimed in claim 1, 2 or 3 wherein a respective ring is coated with a polymeric resin material.

17. An on-machine-seamable industrial fabric as claimed in claim 1, 2 or 3 wherein a respective ring is open at one of two ends and closable by way of a closure selected from the group comprising a snap and a clamp.

18. An on-machine-seamable industrial fabric as claimed in claim 1, 2 or 3 wherein said rings have a first end and a second end with an opening in at least one of said ends so as to allow said joining members to pass therethrough connecting one ring to the next.

19. An on-machine-seamable industrial fabric as claimed in claim 18 wherein said rings have openings at said first and second ends.

20. An on-machine-seamable industrial fabric as claimed in claim 1 wherein said rings and said joining members are porous.

21. A method of manufacturing an on-machine-seamable industrial fabric, comprising the steps of: providing a flat woven cloth; providing a plurality of porous or nonporous rings; said cloth having machine direction and cross machine direction yarns; attaching said plurality of rings to said cloth, and wherein said plurality of rings are in the cross machine direction or in substantially the cross machine direction.

22. A method for manufacturing an on-machine-seamable industrial fabric, said method comprising the steps of: providing a plurality of porous rings; providing a plurality of porous pintles to be inserted onto the rings; inserting respective pintles into adjacent rings; and indexing said rings forward along the pintle by a predetermined distance.

23. A method of manufacturing an on-machine-seamable industrial fabric, comprising the steps of: providing a flat woven cloth; providing a plurality of porous or nonporous rings; said cloth having machine direction and cross machine direction yarns: and attaching said plurality of rings to said cloth, wherein said plurality of rings are in the machine direction or in substantially the machine direction.

24. A method of manufacturing an on-machine-seamable industrial fabric, comprising the steps of: providing a flat woven cloth; providing a plurality of porous or nonporous rings; said cloth having a plurality of porous joining members extending at oblique angles to the machine direction; and attaching said plurality of rings to said cloth.

* * * * *